United States Patent [19]

Schonewald et al.

[11] Patent Number: 4,793,770

[45] Date of Patent: Dec. 27, 1988

[54] GAS TURBINE ENGINE FRAME ASSEMBLY

[75] Inventors: Roger W. Schonewald, Ipswich; Albert A. Legault, Hamilton, both of Mass.

[73] Assignee: General Electric Company, Lynn, Mass.

[21] Appl. No.: 82,409

[22] Filed: Aug. 6, 1987

[51] Int. Cl.[4] ..... F01D 9/04

[52] U.S. Cl. ..... 415/190; 415/142; 415/217

[58] Field of Search ..... 415/134, 137, 138, 139, 415/142, 185, 189, 190, 191, 194, 195, 201, 219 R, 216, 217, 218

[56] References Cited

U.S. PATENT DOCUMENTS

| | | | |
|---|---|---|---|
| 2,771,622 | 11/1956 | Thorp | 415/192 |
| 2,807,433 | 9/1957 | Halford et al. | 415/217 X |
| 2,869,941 | 1/1959 | Shoup, Jr. et al. | 415/142 X |
| 2,928,648 | 3/1960 | Haines et al. | 415/138 |
| 2,936,999 | 5/1960 | Coar et al. | 415/134 |
| 2,941,781 | 6/1960 | Boyum | 415/142 |
| 3,764,226 | 10/1973 | Matto | 415/219 |
| 4,033,792 | 7/1977 | Giamei et al. | 148/32 |
| 4,132,069 | 1/1979 | Adamson et al. | 60/226 |
| 4,208,777 | 6/1980 | Walsh et al. | 29/418 |
| 4,321,007 | 3/1982 | Dennison et al. | 415/142 |
| 4,369,016 | 1/1983 | Dennison | 415/142 |
| 4,417,850 | 11/1983 | Hacker et al. | 415/142 |
| 4,611,464 | 9/1986 | Hetzer et al. | 415/189 X |

FOREIGN PATENT DOCUMENTS

| | | | |
|---|---|---|---|
| 2149022 | 6/1985 | United Kingdom | 415/142 |

*Primary Examiner*—Robert E. Garrett
*Assistant Examiner*—Joseph M. Pitko
*Attorney, Agent, or Firm*—Francis L. Conte; Derek P. Lawrence

[57] ABSTRACT

A fairing for mounting onto a gas turbine frame to isolate the frame from the hot gases passing the flowpath. The fairing includes mating forward and aft annular sections with each section having an outer wall and an inner wall defining the flowpath therebetween. A plurality of circumferentially-spaced hollow fairing struts radially extends between the inner and outer walls. The two sections are manufactured such that there are no misalignments or steps between the lineup of the two sections. The sections are placed over the frame struts and are coupled together.

20 Claims, 5 Drawing Sheets

GAS TURBINE ENGINE FRAME ASSEMBLY

The Government has rights in this invention pursuant to Contract No. DAAK51-83-C-0014 awarded by the Department of the Army.

BACKGROUND OF THE INVENTION

The present invention relates generally to gas turbine engine frames, and more particularly to a fairing for isolating the frame from hot flowpath gases.

In gas turbine engines, support frame structures are provided along the axial length of the engine. Such structural support is typically needed at the turbine stage, especially where bearing supports are provided between turbine stages. The frame structure generally includes inner and outer shells which are connected by frame struts which cross the flowpath of the working fluid. When such frame structure occurs in the hot section of the engine, such as at the turbine, it is desirable to isolate the frame from the hot flowpath gases.

Protection of the frame is accomplished by providing a fairing which includes an inner and outer flowpath wall connected by a hollow airfoil-shaped fairing strut which surrounds the frame strut to provide thermal protection. Because of the arrangement of having a hollow fairing strut surrounding an interior frame strut, various manufacturing and assembly techniques have been suggested in the prior art.

In one approach, the fairing is formed as a one-piece construction using a casting or other fabrication technique. The frame structure is then manufactured or assembled through the one-piece fairing, which is retained as a single piece. Alternately, in another approach, the frame structure is first formed as a one-piece construction either through casting or other fabrication techniques. The fairing is then manufactured around that frame and connected to it as an inseparable assembly.

In each of these prior art approaches, the techniques of manufacturing result in relatively high costs and the assembled structure is complex. The fairing and the frame become inseparable, and, as a result, it becomes difficult to repair portions of either the frame or the fairing when damage occurs to either.

As part of each turbine stage of the gas engine, there is generally provided nozzle guide vanes to direct combustion gases to the turbine and correct the incidence angle to properly drive the turbine. When the frame and fairing are provided adjacent to the turbine, the nozzle guide vanes are generally axially spaced from the fairing and thereby provide an additional axial component spaced from the fairing, whereby the length of the engine is extended and the weight is increased. Since the fairing is cast or assembled as a separate component, it has heretofore not been feasible to integrate the fairing with the nozzle guide vane structure.

Accordingly, it is an object of the present invention to provide an improved frame assembly including a fairing.

Another object of the present invention is to provide a frame assembly which avoids the manufacture and assembly problems of prior art structures.

Another object of the present invention is to provide a frame assembly having a fairing which can be easily manufactured and assembled onto a gas turbine engine while permitting removability for repair and servicing.

Another object of the present invention is to provide a fairing which is formed integrally with a turbine nozzle section to reduce the overall axial length and weight of the gas turbine engine.

Another object of the present invention is to provide a method of manufacturing a frame and fairing assembly for reduced cost and easier assembly and access for replaceability or repair.

SUMMARY OF THE INVENTION

The present invention comprises a frame assembly for a gas turbine engine. The frame assembly includes an annular fairing structure which mounts onto an annular frame structure to isolate the frame structure from hot flowpath gases. The frame structure includes inner and outer shells interconnected by radial support struts. The annular fairing structure includes an inner flowpath wall positioned radially outwardly of the inner shell and an outer flowpath wall positioned radially inwardly of the outer shell. The flowpath walls define a gas flowpath therebetween. Radial hollow fairing struts surround the frame struts. The annular fairing structure is circumferentially split in an axial plane and has forward and aft fairing sections. Appropriate mechanical connections are provided between the sections for assembling the fairing structure about the frame struts.

In one embodiment of the invention, the frame is manufactured separately from the fairing. The fairing is cast or fabricated in one piece and then machined into the forward and aft sections. The two sections are then assembled around the frame and retained by means of mechanical attachments.

BRIEF DESCRIPTION OF THE DRAWINGS

The novel features believed characteristic of the invention are set forth in the appended claims. The invention, in accordance with a preferred embodiment, together with further objects and advantages thereof is more particularly described in the following detailed description taken in conjunction with the accompanying drawings in which:

DETAILED DESCRIPTION OF THE DRAWINGS

Figure 1:
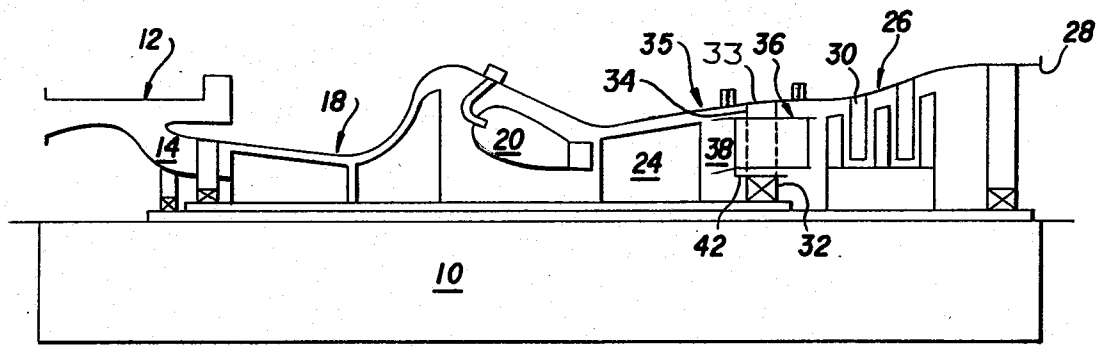
FIG. 1 is a schematic drawing of a gas turbine engine showing the location of frame assembly in accordance with one embodiment of the present invention between a high pressure turbine and a low pressure turbine.

Illustrated in FIG. 1 is a schematic of an exemplary gas turbine engine 10 comprising an inlet 12 through which air is brought into the engine through flowpath 14. The air passes through an axi-centrifugal compressor 18 and combustor 20 and is burned with fuel to generate hot combustion gases. The gases then flow to a high pressure turbine (HPT) 24 and then to a low pressure turbine (LPT) 26, and then are exhausted through an outlet 28.

Associated with each of the turbine stages of the LPT 26 are nozzle guide vanes 30 which serve to direct combustion gases from previous stages to the turbine blades of the next stage and correct the incidence angle to appropriately drive the LPT 26.

Between the HPT 24 and the first stage of the LPT 26 is a main shaft bearing 32 attached to a radially inner end of a turbine frame 33 in accordance with one embodiment of the invention. The frame 33 supports an aft end of the main shaft which joins the HPT 24 to the compressor 18. The frame 33 comprises a plurality of circumferentially-spaced radial frame struts 34 extending radially inwardly from a portion of an engine casing 35. A fairing 36 surrounds the struts 34 and isolates the struts 34 from the hot flowpath gases flowing through a flowpath 38 from the HPT to the LPT 26.

The construction of a prior art fairing and its assembly with a prior art frame has previously resulted in a complex assembly having inseparable parts. This caused increased cost for such manufacture and assembly and also provided difficulty when repairs were necessary.

Illustrated in more particularity in FIGS. 2–5 is an exemplary, preferred embodiment of the fairing 36 which can be manufactured as a casting or other fabrication independently of the frame 33 and then placed onto the frame 33 and mechanically secured in place.

In accordance with a preferred embodiment of the present invention, the annular frame 33 for supporting the aft end of the main shaft includes an outer shell 40, which is a portion of the casing 35, and an inner shell 42 which are interconnected by the struts 34. The struts 34 are transverse to the gas flowpath 38 and thereby would channel, but for the fairing 36, the hot gases entering into the LPT 26. In order to protect the frame 33, the fairing 36 is provided.

Figure 5:
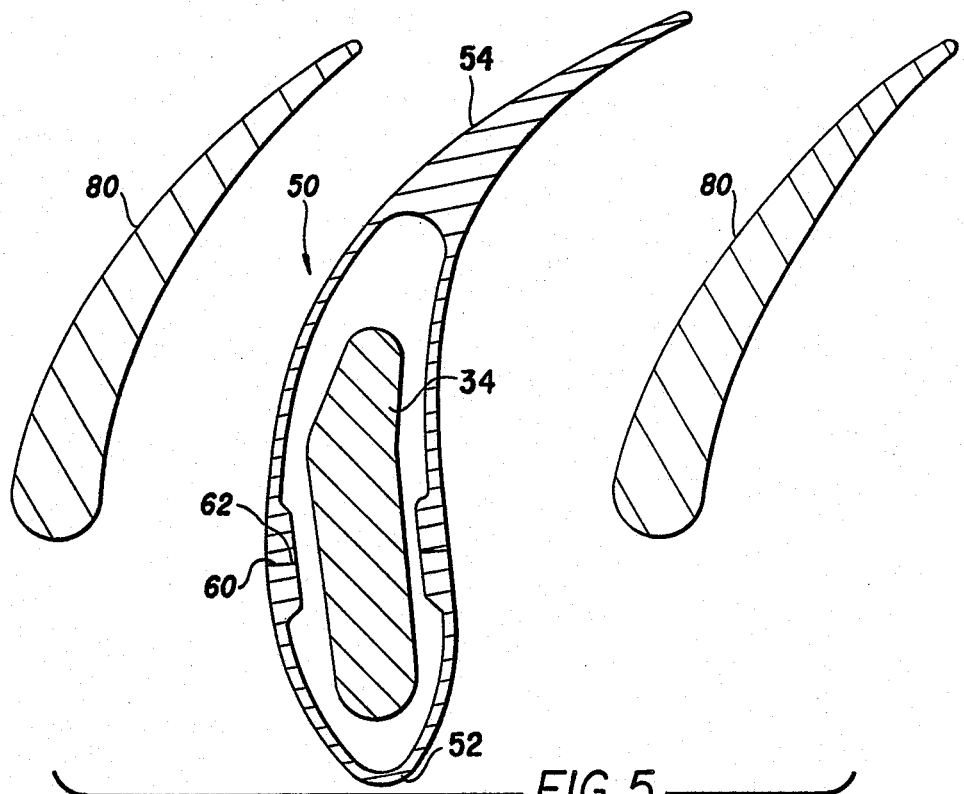
FIG. 5 is a sectional view taken along lines 5—5 of FIG. 3 and showing the airfoil shape of the fairing strut.

The fairing 36 includes an inner flowpath wall 46 spaced outwardly of the inner shell 42. An outer flowpath wall 48 is also provided which is spaced inwardly of the outer shell 40. Interconnecting the inner and outer walls 46, 48 is a plurality of fairing struts 50. As best shown in FIG. 5, each fairing strut 50 is hollow and has an arcuate U-shaped forward section 52. An aft end 54 of the strut 50 is also U-shaped and, together with the forward section 52, results in an airfoil-shaped strut 50 effective as a vane for use with nozzle guide vanes, as will hereinafter be explained.

Figure 2:
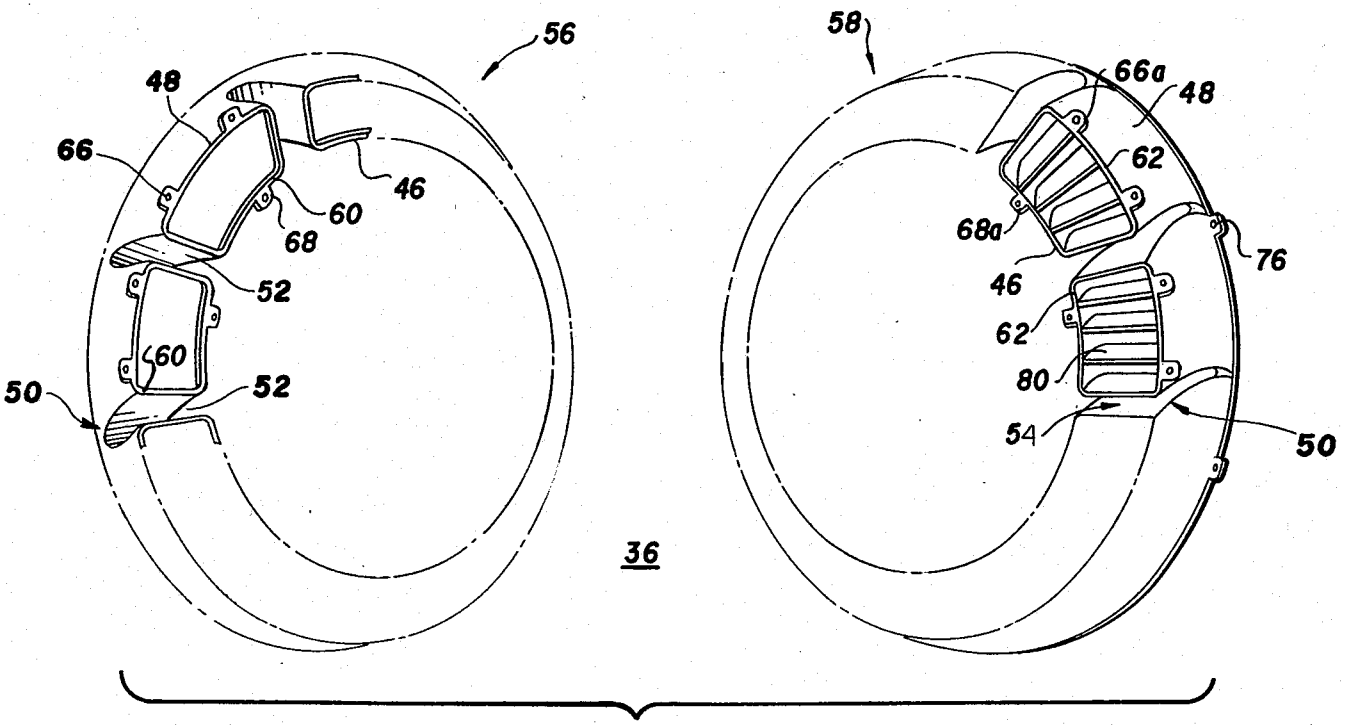
FIG. 2 is a perspective exploded view of the forward and aft sections of a fairing structure prior to its assembly about frame struts of the frame assembly.

As best seen in FIG. 2, the fairing 36 comprises two complementary sections including a forward section 56 and an aft section 58. The two sections have abutting mating faces including a face 60 on the forward section 56 and a corresponding mating face 62 on the aft section 58.

In order to secure the sections together, abutting tabs are provided. On section 56, there is a plurality of circumferentially spaced tabs 66 projecting radially outwardly from the upper flowpath wall 48. There is also a plurality of tabs 68 projecting radially inwardly from the inner flowpath wall 46. Corresponding mating tabs 66*a* and 68*a* are likewise provided on the mating aft section 58. The tabs 66 and 66*a*, and 68 and 68*a*, are then secured together by means of bolts 70, 72, as shown in FIG. 3, or other type of mechanical attachment means.

Figure 3:
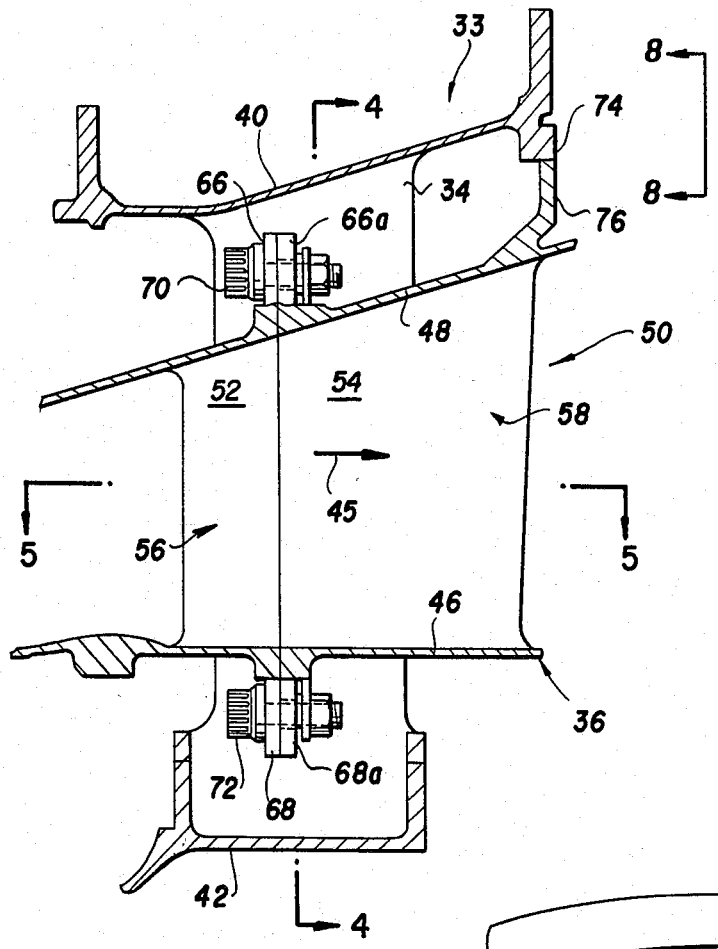
FIG. 3 is a side elevational view of a frame strut covered by a fairing strut of the frame assembly.
Figure 8:
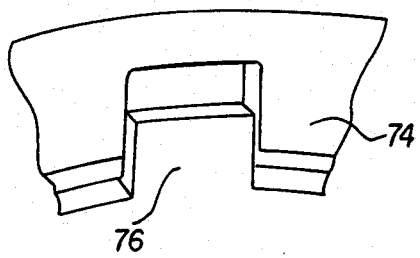
FIG. 8 is an end view of the mating tabs illustrated in FIG. 3 taken along lines 8—8.
Figure 4:
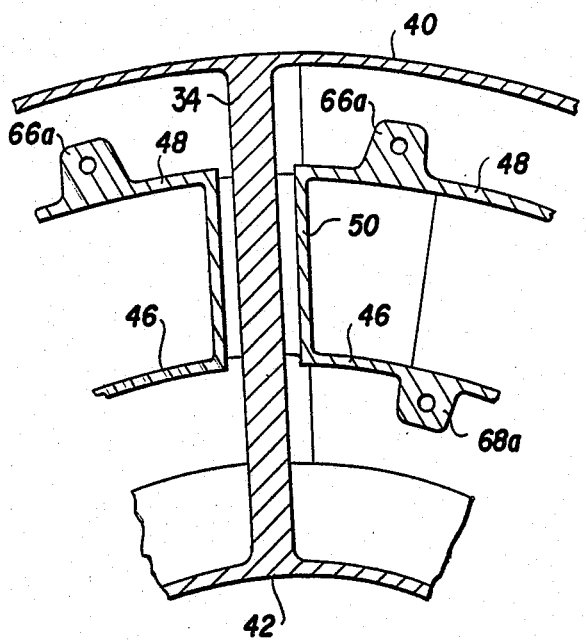
FIG. 4 is a sectional view taken along lines 4—4 of FIG. 3.

In order to properly position the fairing 36, there is provided a plurality of circumferentially spaced radial tabs 74 downwardly projecting from the outer shell 40 which engage a plurality of circumferentially spaced mating tabs 76 upwardly projecting at the rear of the upper flowpath wall 48 as shown in FIGS. 3 and 8. This provides centralizing and circumferential positioning of the fairing 36 and proper positioning of the fairing axially relative to the frame structure. However, it should be noted that the fairing is thermally unrestrained by means of the radial tabs 74, which are allowed to move radially relative to the tabs 76. In this way, the frame 33 and fairing 36 do not thermally restrain each other and therefore provide longer part life.

The frame 33 can be completely manufactured separately from the fairing 36. The fairing 36 could be cast or fabricated in a one-piece structure. It can then be machined into the forward section 56 and the aft section 58. The two sections can then be assembled around the frame 33 and bolted together, and then the assembled fairing 36 is conventionally secured to the outer shell 40 near the tabs 74.

As a result of the ability to form the fairing 36 separately from the frame 33, the present invention provides for lower possible costa for the manufacturing of each. Additionally, by making the fairing 36 initially as one piece and then splitting it, the flowpath mating surface 60, 62 can be matched up almost perfectly. Such matching avoids steps, shoulders or other misalignments which might otherwise occur. Such steps and shoulders would normally cause performance losses in the flowpath. By avoiding making the fairing sections56, 58 separately, such losses are eliminated.

Since the fairing sections 56, 58 are mechanically attached together, the fairing 36 itself can be disassembled from the frame 33 to allow for easier repair and better maintainability. Thus, should any of the parts require repair, changing or removal, it is easy to disassemble.

As shown in FIGS. 2 and 5, in addition to forming just the fairing 36, the fairing struts 50 (forward section 52 and aft section 54) can be interspersed with nozzle guide vanes 80. The shape of the fairing struts 50 is generally similar to the shape of the vanes 80, so that the struts 50 also serve simultaneously as some of the vanes 80.

In the example as shown in FIG. 2, there are provided twelve fairing struts 50 (only three shown) and thirty-six nozzle vanes 80 (only six shown), three vanes 80 being spaced between each two adjacent struts 50. It should be noted that, since the vanes 80 are shorter in axial length than the struts 80, although the struts 50 are made in two sections, one part of which is in the fairing forward section 56 and the other of which is in fairing aft section 58, the vanes 80 can be formed entirely in one section, for example in the fairing aft section 58 as shown in FIG. 2.

It should also be noted that the fairing struts 50 themselves are not necessarily split exactly in half, as is best shown in FIG. 5. The split is preferably made to avoid splitting the vanes 80 and so that a larger portion is formed within the aft section 58 and a smaller portion is formed within the forward section 56 to facilitate joining the sections 56, 58 and casting the vanes 80 in one section alone.

It should also be noted that, although there are twelve fairing struts 50 in this exemplary embodiment, there are only six struts 34, one strut 34 being disposed in every other fairing strut 50. The other struts 50 would typically contain service lines for channeling oil and air to and from the engine sump in a conventional manner.

By combining the fairing 36 and turbine nozzle vanes 80 as a single unit, it is possible to eliminate the need of having a separate axial section for nozzle guide vanes spaced from the fairing 36. In this way, the overall axial length and weight of the gas turbine engine 10 can be reduced.

Figure 6:
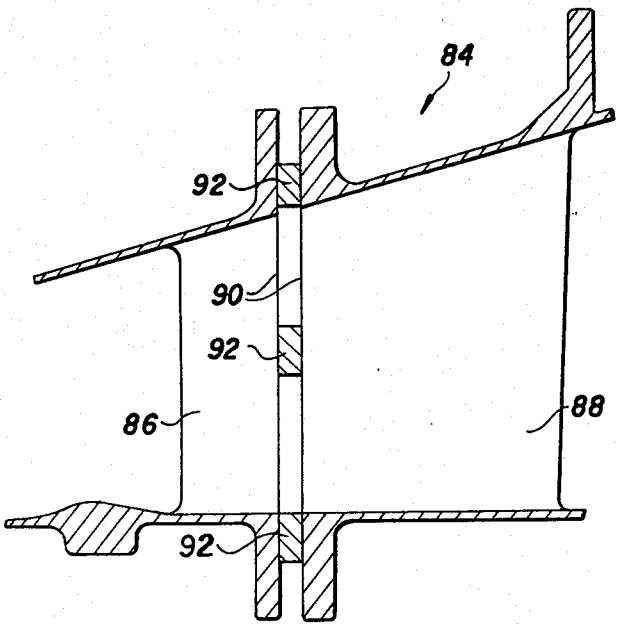
FIG. 6 is a side elevational view of a fairing strut manufactured in accordance with another method of the present invention.

While there has been described herein what is considered as a preferred embodiment of the invention including manufacturing the fairing 36, other alternative methods of manufacturing can be used for assuring lineup of the flowpath surfaces 46, 48 in the fairing 36 when casting the fairing 36. By way of example, instead of casting the fairing 36 as one complete piece, and then machining it into the forward and aft sections 56, 58, an alternate method can be used, as is shown in FIG. 6. Specifically, a fairing 84 can be cast as one piece including a forward section 86 and an integral aft section 88. Along a split line 90, local cast-in tabs 92 connect the two sections 86, 88 together. The two sections can then be conventionally separated by splitting of the two sections using, for example, an Electro-Discharge Machine (EDM) to remove the metal tabs 92. Such EDM method of machining casting parts is well known in the art and would be useful in providing the two sections 86, 88 with aligned mating interfaces and thereby avoiding any step or disturbances in the uniform flowpath.

Figure 7:
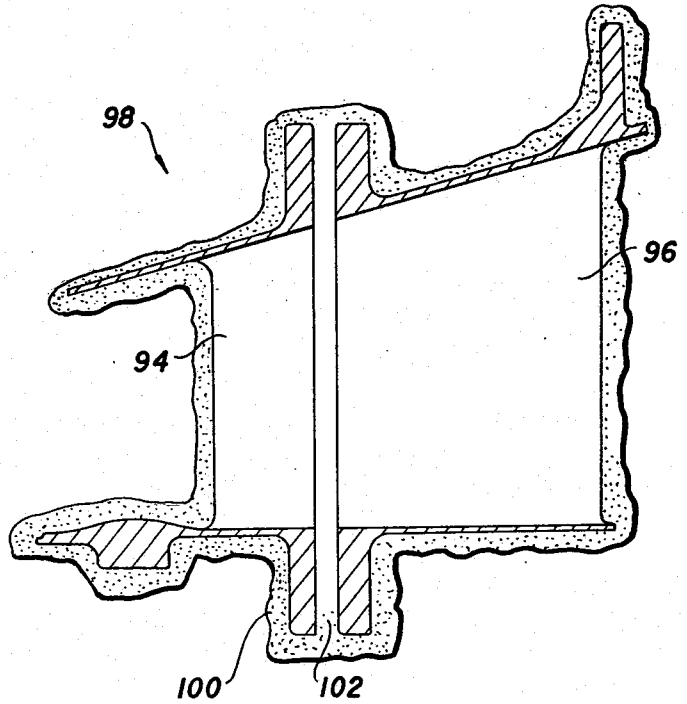
FIG. 7 is a side elevational view similar to that shown in FIG. 6 and showing yet a further method of manufacturing the fairing structure.

Another method of assuring lineup of the flowpath surfaces 46, 48 in a fairing 98 is to cast the two sections of the fairing 98 as separate forward and aft sections 94, 96 as shown in FIG. 7. However, the cast is made as closely together as possible in the same mold. Specifically, the forward section 94 and the aft section 96 of the fairing 98 are shown being cast in a common mold shell 100. Although the two sections 94, 96 are cast separately, as is shown by a spacing 102 therebetween, by casting them in the same mold at the same time, it allows any distortion or out of roundness to be the same in both sections. As a result, when the two sections are jointed, they will have a mating, aligned interface with accurate lineup, avoiding any misalignment steps or shoulders which would otherwise disturb the flowpath.

While there have been described herein what are considered to be preferred embodiments of the invention, other modifications will occur to those skilled in the art from the teachings herein, and it is therefore desired to secure in the appended claims all such modifications that fall within the true spirit and scope of the invention.

Having thus described preferred embodiments of the invention, what is claimed as novel and desired to be secured by Letters Patent Of The United States is:

1. A frame assembly for a gas turbine engine comprising:

an annular frame including an inner shell, an outer shell, and radial support struts interconnecting said inner and outer shells and positionable transversely across a gas flowpath;

an annular fairing for isolating said frame from hot flowpath gases, said fairing comprising:

an inner flowpath wall positioned radially outwardly of said inner shell, an outer flowpath wall positioned radially inwardly of said outer shell, said flowpath walls defining the gas flowpath therebetween, radial hollow fairing struts surrounding said frame struts, and said fairing being circumferentially split to comprise forward and aft fairing sections for allowing assembly of said fairing sections about said frame struts;

and coupling means for assembling said fairing sections about said frame struts.

2. A frame assembly according to claim 1 wherein said fairing struts comprise an airfoil shape.

3. A frame assembly according to claim 2 wherein said fairing struts are vane shaped and form a portion of a turbine nozzle.

4. A frame assembly according to claim 3 further comprising a plurality of nozzle vanes radially positioned between said inner and outer flowpath walls, and circumferentially interspersed with said fairing struts.

5. A frame assembly according to claim 4 wherein said vanes are provided entirely in only one of said forward and aft sections.

6. A frame assembly according to claim 5 wherein said vanes are provided in said fairing aft section.

7. A frame assembly according to claim 1 wherein said forward and aft fairing sections include a plurality of confronting tabs, circumferentially shaped apart and radially outwardly projecting from said outer flowpath wall, and mechanical attachment means for interconnecting said tabs to secure said sections together.

8. A frame assembly according to claim 1 wherein said forward section is axially shorter than said aft section.

9. A fairing assembly for mounting onto a gas turbine frame to isolate the frame from hot flowpath gases, said fairing assembly comprising mating forward and aft annular sections, each section comprising an outer wall, an inner wall, a gas flowpath being defined between said inner and outer walls, a plurality of circumferentially-spaced hollow fairing struts radially extending between said inner and outer walls, and coupling means for matingly securing said annular sections together about the frame.

10. A fairing assembly according to claim 9 wherein the sections mate together so that respective inner and outer walls align with each other without any misalignment shoulders therebetween.

11. A fairing assembly according to claim 9 wherein said mating fairing struts compositely form an airfoil shape.

12. A fairing assembly according to claim 11 further comprising a plurality of circumferentially-spaced nozzle guide vanes radially extending between said inner and outer walls and interspersed with said fairing struts.

13. A fairing assembly according to claim 11 wherein said guide vanes are provided in only one of said forward and aft sections.

14. A fairing assembly according to claim 11 wherein said coupling means comprise a plurality of circumferentially-spaced tabs confrontingly provided on each section and radially projecting from the outer wall thereof and the inner wall thereof, and mechanical attachment means for interconnecting said tabs to secure said sections together.

15. A method of providing a fairing for a gas turbine frame to isolate the frame from hot flowpath gases, said method comprising the steps of:

(a) forming as a unitary assembly forward and aft annular sections of the fairing with each section including an outer casing, an inner casing, and mating parts of radial hollow fairing struts;

(b) separating said unitary assembly into the forward and aft sections providing mating joining faces without misalignment shoulders;

(c) assembling the forward and aft sections with respect to the frame to define a flowpath through the fairing and to isolate the frame from the flowpath gases; and (d) attaching the forward and aft sections together.

16. A method according to claim 16 wherein the forward and aft sections are cast as one piece and split into said forward and aft sections.

17. A method according to claim 15 wherein the forward and aft sections are cast as one piece with local tabs connecting the two sections at the split line.

18. A method according to claim 17 further comprising the step of splitting said one piece using electro-discharge machining.

19. A method according to claim 15 wherein the forward and aft sections are cast close together in the same mold as two sections, wherein any distortion or out of roundness will be the same in both parts.

20. A method according to claim 15 further comprising the step of forming radial nozzle guide vanes in at least one of the sections with said guide vanes interspersed with said fairing struts.

* * * * *